US010981632B2

(12) United States Patent
ter Schure

(10) Patent No.: US 10,981,632 B2
(45) Date of Patent: Apr. 20, 2021

(54) ROLLER TOWING BITT

(71) Applicant: DMT Marine Equipment SA, Vanatori (RO)

(72) Inventor: Petrus Siebrandus ter Schure, Zwolle (NL)

(73) Assignee: DMT Marine Equipment SA, Vanatori (RO)

( * ) Notice: Subject to any disclaimer, the term of this patent is extended or adjusted under 35 U.S.C. 154(b) by 0 days.

(21) Appl. No.: 16/344,030

(22) PCT Filed: Oct. 25, 2017

(86) PCT No.: PCT/EP2017/077364

§ 371 (c)(1),
(2) Date: Apr. 23, 2019

(87) PCT Pub. No.: WO2018/077982

PCT Pub. Date: May 3, 2018

(65) Prior Publication Data

US 2020/0062347 A1 Feb. 27, 2020

(30) Foreign Application Priority Data

Oct. 25, 2016 (NL) ..... 2017673

(51) Int. Cl.
*B63B 21/10* (2006.01)
*B66D 1/38* (2006.01)

(52) U.S. Cl.
CPC ..... *B63B 21/10* (2013.01); *B66D 1/38* (2013.01); *B66D 2700/0191* (2013.01)

(58) Field of Classification Search
CPC .. B63B 21/10; B66D 1/36; B66D 1/38; B66D 2700/0191
See application file for complete search history.

(56) References Cited

U.S. PATENT DOCUMENTS

| | | | | |
|---|---|---|---|---|
| 1,943,433 A | | 1/1934 | Heighton | |
| 2,473,628 A | * | 6/1949 | Allison | B66D 1/36 242/157.1 |
| 2,783,025 A | | 2/1957 | Scheidt | |
| 3,035,535 A | * | 5/1962 | Billups | B63B 21/04 114/294 |
| 3,718,108 A | * | 2/1973 | Janssen | B63B 21/56 114/181 |
| 3,785,511 A | * | 1/1974 | Bonnamy | E21B 19/09 414/139.7 |

(Continued)

FOREIGN PATENT DOCUMENTS

JP S49 91095 U 8/1974

*Primary Examiner* — Sang K Kim
*Assistant Examiner* — Nathaniel L Adams
(74) *Attorney, Agent, or Firm* — N.V. Nederlandsch Octrooibureau; Catherine A. Shultz; Katelyn J. Bernier

(57) ABSTRACT

A towing bitt assembly comprising:
- an arched structure defining an opening for a towing rope to run there through;
- a roller assembly comprising
  - a coupling means for coupling the roller assembly to the arched structure so that the roller assembly is movable along a centre line of the arched structure; and
  - a roller means for guiding the towing rope, the roller means being rotatable around the centre line of the arched structure.

16 Claims, 7 Drawing Sheets

(56) References Cited

U.S. PATENT DOCUMENTS 4,778,121 A * 10/1988 Minnee ..... B66D 1/38
242/157.1
8,333,162 B2 * 12/2012 Chapman ..... B63B 21/04
114/218

* cited by examiner

ROLLER TOWING BITT

FIELD OF THE INVENTION

The present invention relates to a towing bitt assembly to be used in towing ships for towing and escorting maneuvers.

BACKGROUND ART

Towing ships for carrying out towing and escorting maneuvers need to provide a significant pulling force, which is transmitted through a towing rope or line, in order to be able to tow a vessel. The towing rope that connects the towing boat and the vessel must therefore resist a substantial force. Towing bitt assemblies known in the art have a static bitt structure such that when the towing rope continuously slides through a towing bitt located on the deck of the towing boat, abrasion and wear can seriously damage the towing bitt structure as well as the towing line. In fact, towing lines need to be replaced regularly, which is relatively expensive, and furthermore, a towing line failure could put the vessel and his load in danger.

There is therefore a need for a towing system that allows for safe rendering and recovery features without damaging the towing system structure or the towing rope.

SUMMARY OF THE INVENTION

The present invention reduces the abrasion and wear effects present in the conventional towing systems, both in harbor maneuvers and off-shore.

The invention provides a towing bitt assembly comprising:

- an arched structure defining an opening for a towing rope to run there through;
- a roller assembly comprising
  - a coupling means for coupling the roller assembly to the arched structure so that the roller assembly is movable along a centre line of the arched structure; and
  - a roller means for guiding the towing rope, the roller means being rotatable around the centre line of the arched structure.

The invention advantageously provides a towing bitt assembly with a roller assembly that can be moved along a supporting structure such as an arched structure. The roller assembly comprises a roller means so that the roller assembly can also rotate around the arched structure when a towing rope is under an external pulling force and it slides over the roller means. The arched structure can have a U-shape, with the ends of the "U" to be attached to the deck.

An embodiment of the invention provides a towing bitt assembly further comprising at least one damper means connected to the arched structure and to the roller assembly, wherein the at least one damper means is configured to exert a force causing the roller assembly to move to a central position along the arched structure.

In this way, the invention advantageously provides a mechanism for bringing the roller assembly to a neutral position when no external pulling force applied to the rope makes the roller assembly move along the arched structure.

Another embodiment of the invention provides a towing bitt assembly wherein an even number of damper means are provided, positioned symmetrically with respect to a plane through the central position along the arched structure. Yet another embodiment of the invention provides a towing bitt assembly wherein the damping means are hydraulic damping means.

An embodiment of the invention provides a towing bitt assembly wherein the roller assembly comprises a nozzle for the towing rope to run there through.

The rope can in this manner be confined within the nozzle when it passes through the opening of the supporting structure such as the arched structure and it slides upwards making the roller means rotate. The nozzle may act as a guide that helps the rope to be kept within the roller means.

An embodiment of the invention provides a towing bitt assembly wherein the roller means is formed as a wheel having a concave outer surface for guiding the towing rope. This shape allows for a better coupling of the rope with the roller means and prevents the rope to move outside the roller means.

An embodiment of the invention provides a towing bitt assembly wherein at least one slide bearing is provided between the roller means and the coupling means. The at least one slide bearing provides a simple rolling mechanism that reduces rotational friction.

An embodiment of the invention provides a towing bitt assembly wherein the arched structure comprises at least one guide to which the coupling means is coupled for guiding movement along the centre line of the arched structure.

An embodiment of the invention provides a towing bitt assembly wherein the roller assembly can be moved along the arched structure within an angular range between −90 degrees and +90 degrees, wherein an angular position within the angular range is defined with respect to a central position along the arched structure. By allowing the roller assembly to be moved within an angular range along the arched structure, abrasion in the towing bitt and in the towing rope is reduced because the roller assembly will move along the arched structure based on the direction of the external pulling force applied to the rope.

An embodiment of the invention provides a towing bitt assembly wherein at least one stopper is located on each side of the arched structure to keep the roller assembly within a predefined angular range with respect to a central position along the arched structure. These stoppers provide an extra level of safety and accuracy as they avoid that the roller assembly is stuck in the straight part of the arched structure.

An embodiment of the invention provides a towing bitt assembly wherein the angular range is between −90 degrees and +90 degrees, preferably between −80 degrees and +80 degrees with respect to the central position along the arched structure.

An embodiment of the invention provides a towing bitt assembly wherein the arched structure has a U-shape.

An embodiment of the invention provides a towing bitt assembly further comprising a deck housing for fixing the arched structure to a deck of a boat.

An embodiment of the invention provides a towing bitt assembly wherein the deck housing allows the arched structure to have one of at least a first and a second position, the first and the second position being spaced apart by a distance. The arched structure may be placed in a position that is more convenient.

An embodiment of the invention provides a towing bitt assembly further comprising a towing winch with a first and a second drum, wherein the first position is aligned for guiding a rope from the first drum and the second position is aligned for guiding a rope from the second drum.

An embodiment of the invention provides a towing bitt assembly wherein the deck housing comprises a guiding system, and wherein the arched structure is configured to slide along the guiding system of the base in order to move between the first and the second position. The arched structure may be moved through the guiding system along the deck housing so that it can be placed in the first position for guiding the towing rope from the first drum, and in the second position for guiding the towing rope from the second drum.

BRIEF DESCRIPTION OF THE DRAWINGS

The present invention will be discussed in more detail below, with reference to the attached drawings, in which.

DESCRIPTION OF EMBODIMENTS

Figure 1:
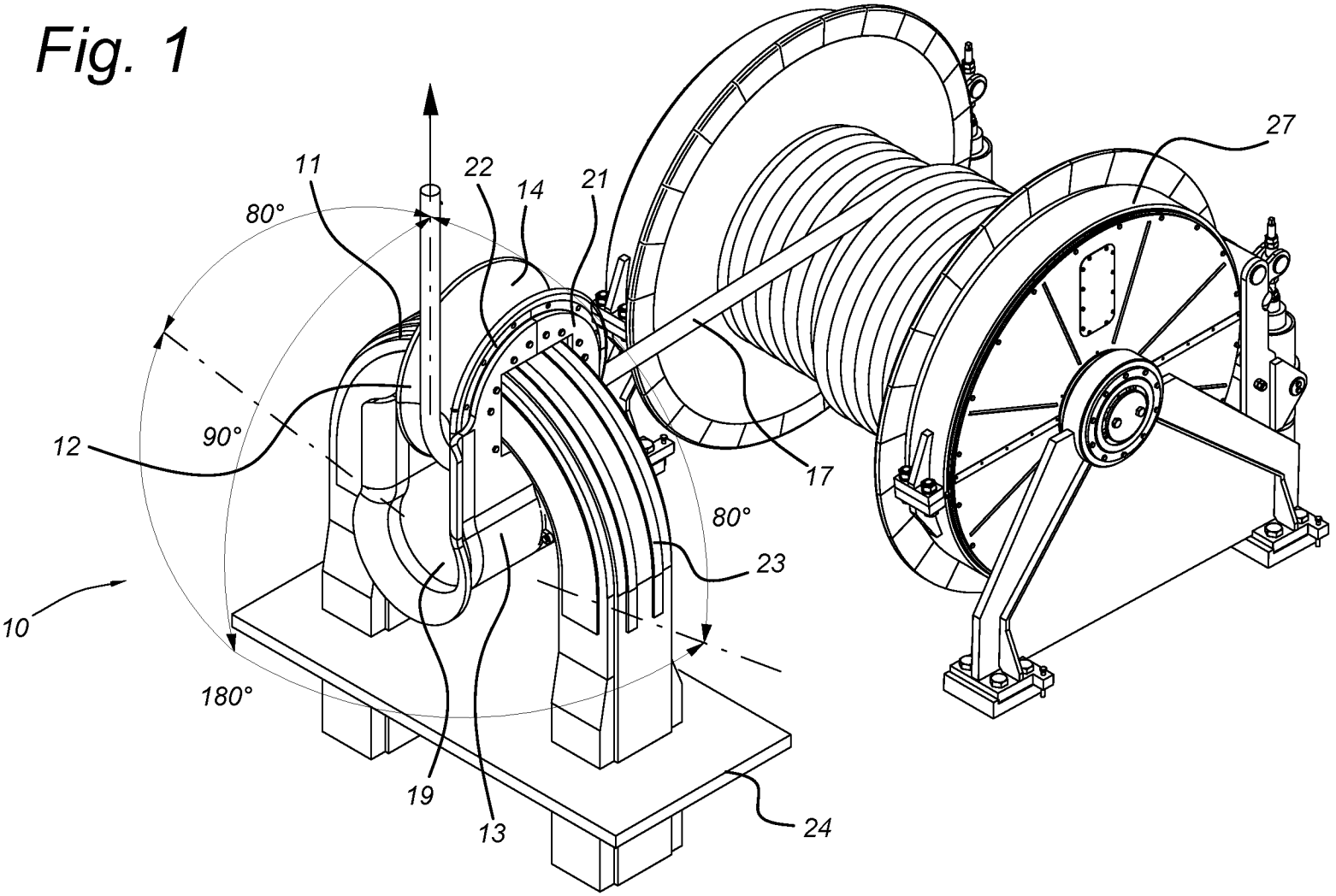
FIG. 1 depicts an isometric view of a towing bitt assembly according to an embodiment of the invention

FIG. 1 depicts an isometric view of a towing bitt assembly according to an embodiment of the invention.

A towing bitt assembly 10 according to an embodiment of the present invention may comprise a supporting structure with an opening for a towing rope to run there through. In a preferred embodiment, the supporting structure has an arched structure 11. The towing bitt assembly may further comprise a roller assembly 12 coupled to the arched structure 11. The roller assembly 12 may consist of a coupling means 13 and a roller means 14. The coupling means 13 may be coupled to the arched structure 11 and allow the roller assembly 12 to move along the arched structure. The coupling means may further comprise a nozzle 19 so that a towing rope 17 that is to pass through the opening of the arched structure 11 passes through the nozzle 19. The towing rope may be for example made of nylon or yarns, or any other suitable material. The roller means 12 may be interlaced with the coupling means 13 through the nozzle 19 of the coupling means, such that the roller means 14 surrounds the section of the coupling means 13 that is coupled to the arched structure 11. The roller means is configured to rotate around a centre line of the arched structure in order to guide the towing rope.

The towing bitt according to an embodiment of the invention has therefore a roller assembly 12 that can move along the arched structure 11 and at the same time rotate around the arched structure. Depending on the direction of the pulling force applied on the towing rope, the roller assembly 12 will rotate along the arched structure within a predetermined range. The rotating mechanism of the roller means 12 will be explained in more detail in relation with the following figures. The towing bitt assembly 10 according to an embodiment of the present invention may be fixed to a deck of a boat or ship, preferably a towing ship, either in the bow side or in de stern side of the ship. This may be done by welding, or the roller bitt assembly may further comprise a deck housing 24 for fixing the towing bitt assembly 10 to the deck of the ship.

The towing bitt assembly 10 according to the present invention is suitable to be used at various temperatures, both above zero and below zero degrees Celsius, including extreme temperature conditions. For that, the materials used in the different elements of the towing bitt assembly must be suitable to resist extreme temperature conditions. The arched structure 11, the roller assembly 12 and the deck housing 24 may be preferably made of stainless steel in order to resist the weather conditions.

Figure 2:
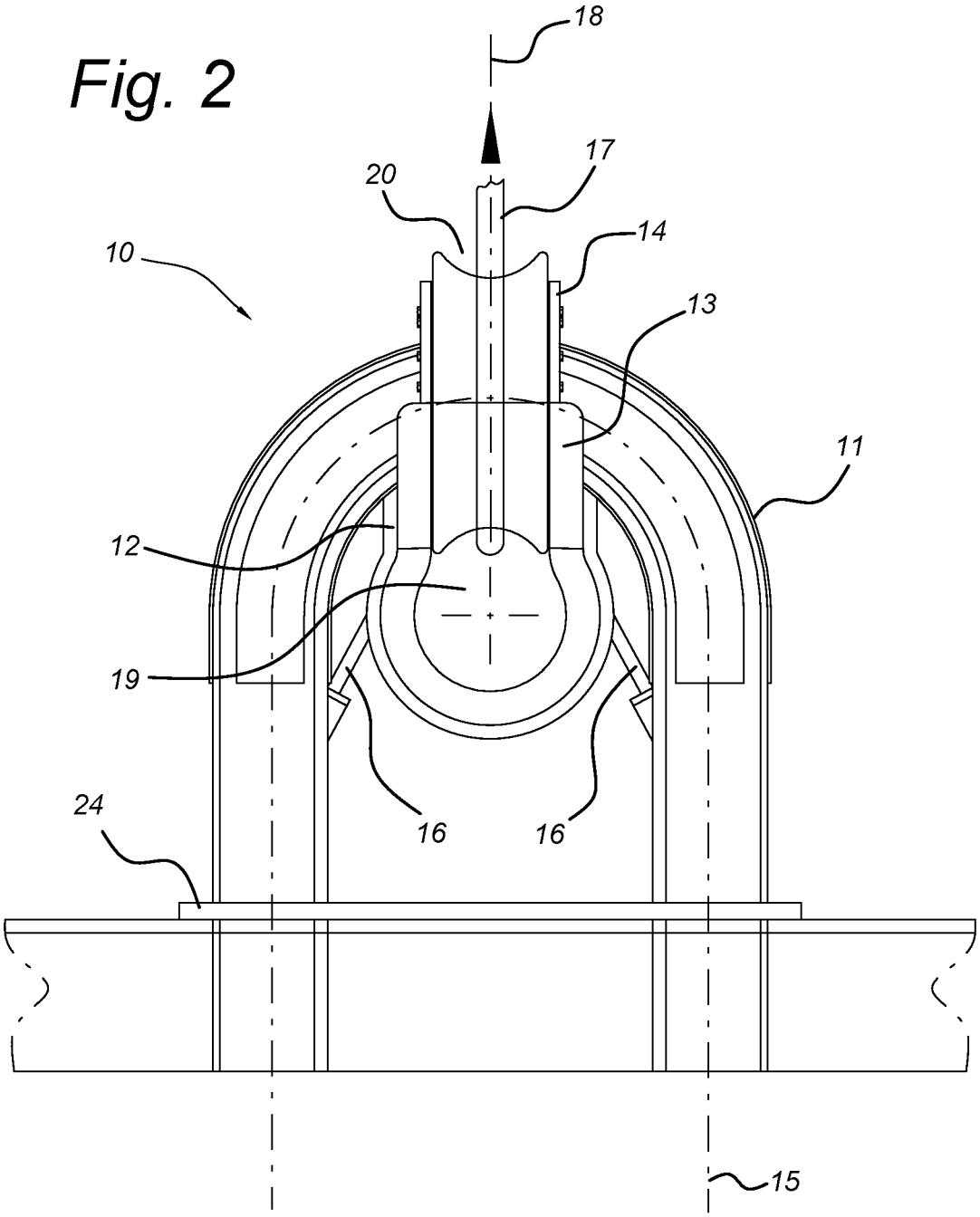
FIG. 2 shows a front view of a towing bitt assembly in a neutral position according to an embodiment of the invention

FIG. 2 shows a front view of a towing bitt assembly in a neutral position according to an embodiment of the invention.

From FIG. 2 it can been seen that the roller assembly 12 may be moved along the centre line 15 of the arched structure 11. Preferably, the roller assembly 12 may be moved along the centre line 15 of the arched structure 11 within a predetermined angular range with respect to a central position 18 of the arched structure. When an external pulling force is pulling the towing rope 17, the roller means 14 may rotate around the centre line 15 of the arched structure 11 to guide the rope. Furthermore, the rope is usually not pulled by the external force from a vertical direction, since the pulling direction will depend on the position of the assisted ship in relation with the towing ship. Taking this into account, the roller assembly 12 can move along the arched structure 11 depending on the pulling direction, and in this manner wear in the towing bitt and in the rope is considerably reduced.

The roller means 14 according to an embodiment of the invention may have a wheel-like shape with a concave outer surface, so that the towing rope 17 is confined within said concave outer surface and it can be guided when pulled without the risk of it moving out of the roller means 14. The width of the concave outer surface is such that a rope 17 with a diameter between 40 mm and 200 mm, or even larger, more preferably between 40 mm and 160 mm, can smoothly pass through. The roller bitt assembly 10 according to the present invention may therefore be used for a large range of rope sizes, and it may be designed to resist high pulling forces on the rope, with a safe working load (SWL) between 100 and 250 metric tons. The concave outer surface may be designed to fit smoothly with the inner surface of the nozzle 19 (see FIG. 2), so that when a rope moves from the concave surface to the inner surface of the nozzle 19, the rope experiences minimal friction. As schematically shown in FIG. 2, the curvature is of the concave surface may be similar to the curvature of the inner surface of the nozzle, to provide an overall smooth surface for the rope running through the nozzle 19.

The towing bitt assembly 10 according to an embodiment of the present invention further comprises damper means 16. The damper means comprises preferably a plurality of damper means 16, preferably an even number of damper means positioned symmetrically with respect to a plane through the central position 18 along the arched structure 11, for example two or four damper means. The at least one damper means 16 is connected to the arched structure 11 and to the roller assembly 12 and it is configured to exert a force causing the roller assembly to move to a central position 18 along the arched structure.

More specifically, each of the at least one damper means 16 may have one end connected to the roller assembly 12, more preferably to a section of the coupling means 13 that comprises the nozzle 19. Each of the at least one damper means 16 may have the other end connected to the arched structure 11, to a position in the arched structure that may be appropriate for the damper means to achieve an effective damping effect. In a preferred embodiment, the second end of the at least one damper means 16 may be connected to a position in the lower half of the arched structure. In the following description, by way of simplicity, it will be considered that the towing bitt assembly 10 comprises two damper means 16. However, it should be understood that a different number of damper means may be used.

The damper means 16 may be configured to bring the roller assembly 12 to a neutral position, which may be a central position 18 of the arched structure 11. This advantageously allows for the roller assembly 12 to be in a neutral and resting position when a low external pulling force or no external pulling force ("slack wire") is being applied to the rope 17. The damper means 16 according to an embodiment of the present invention may be hydraulic damper means, but it should be clear for a skilled person that any other type of suitable damper elements could be used. For different sizes of the towing bitt, or for different working conditions, pneumatic, electric or hydraulic damper elements, or any combination thereof, could also be used.

Figure 3:
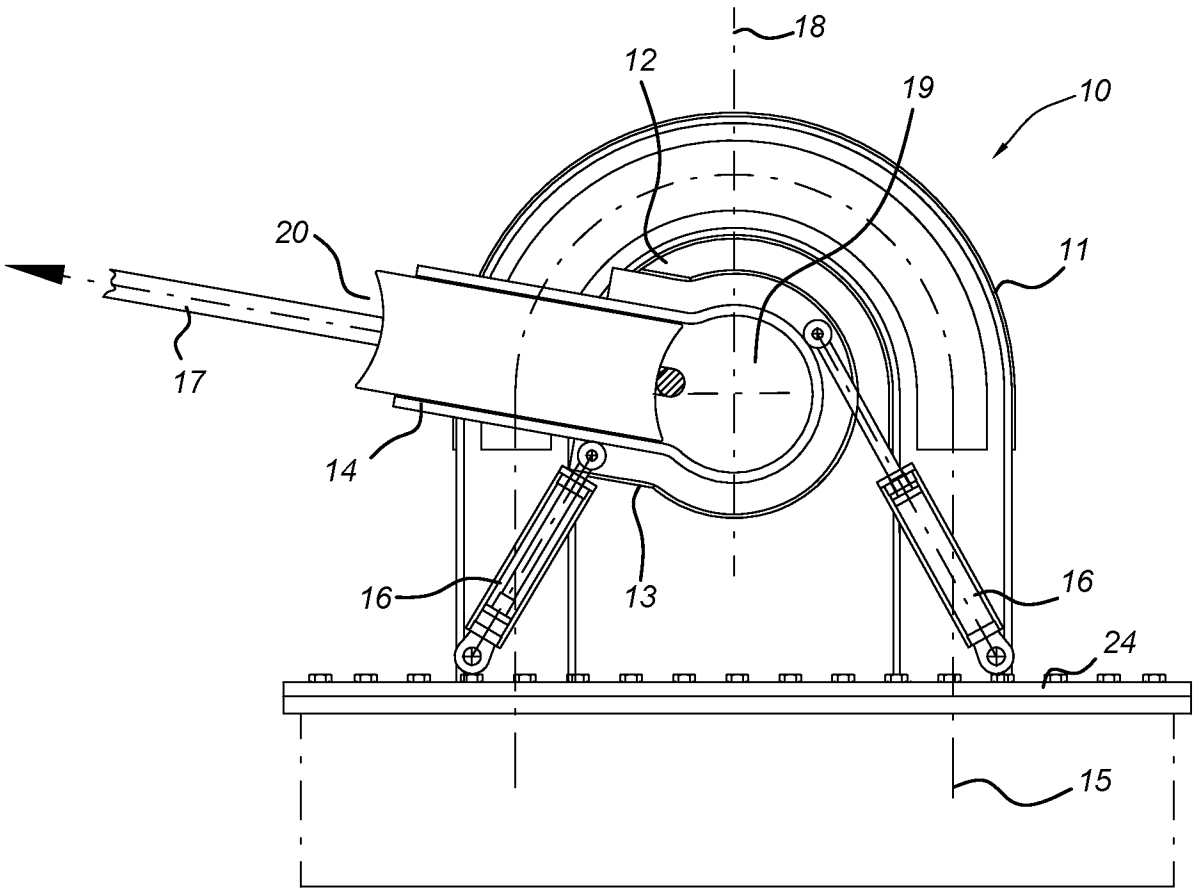
FIG. 3 depicts a front view of a towing bitt assembly in an active position according to an embodiment of the invention

FIG. 3 depicts a front view of a towing bitt assembly in an active position according to an embodiment of the invention.

The roller assembly 12 of the towing bitt assembly 10 according to an embodiment of the invention can move along a centre line 15 of the arched structure 11 within a predetermined angular range. The roller assembly 12 may be moved from an angular position of −90 degrees to +90 degrees with respect to the central position 18 of the arched structure, preferably from −80 degrees to +80 degrees. It is preferred that the angular range is between −80 degrees and +80 degrees because the towing bitt assembly 10 will be preferably placed on the deck of a towing ship and other elements of the towing ship including the handrails have a specific height that would interfere when a rope 17 attached to an assisted ship is pulled by the towing ship.

The towing bitt assembly 10 according to embodiments of the present invention may have a different size depending on the required design load. Embodiments of the present invention may be configured to support a design load of between 50 and 300 metric tons. According to an embodiment of the invention, for a towing bitt assembly configured to support a maximum of about 170 metric tons, the towing bitt assembly may have a height between 250 cm and 350 cm, and a breadth between 200 cm and 300 cm.

Figure 4:
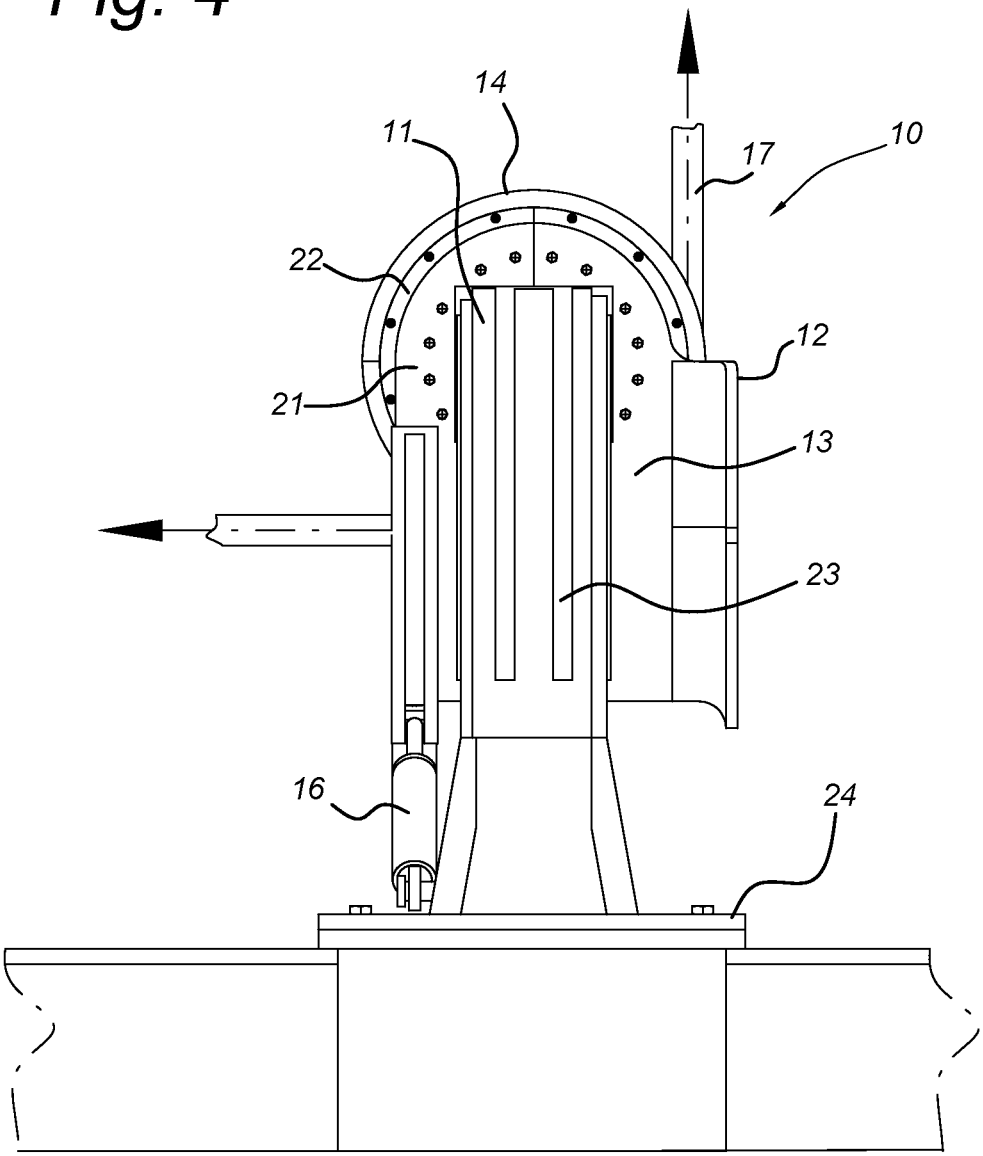
FIG. 4 illustrates a side view of a towing bitt assembly according to an embodiment of the invention

FIG. 4 illustrates a side view of a towing bitt assembly according to an embodiment of the invention.

From FIG. 4 it can be seen that the rotating mechanism of the roller means 14 according to an embodiment of the invention may comprise at least one slide bearing or plain bearing between the roller means 14 and the coupling means 13. This rolling mechanism allows for a reduction in rotational friction. It should however be noted that the invention is not limited to this rolling mechanism, and that other suitable rolling mechanisms could also be used, such as ball bearings, roller bearings, thrust bearings or the like.

In a mounting process, the roller assembly 12 may be coupled to the arched structure 11. This may be done by first fastening the coupling means 13 to the arched structure 11. The coupling means may comprise at least two sections that can be engaged with each other through a cover and a first set of screws 21 when the coupling means 13 is fastened around the arched structure 11. Once the coupling means is fixed, the roller means 14, which may also comprise at least two sections, may be coupled to the coupling means 13 by bringing the at least two sections together around the coupling means and fixing them to each other with a cover and a second set of screws 22. The coupling means 13 may be the bearing and the roller means 14 may the rotating shaft of the slide bearing according to an embodiment of the invention.

Although the outer part of the roller means and the coupling means may be made of stainless steel in order to be able to resist extreme weather conditions, the surfaces of the slide bearing in contact with each other may be made of materials with good self-lubricating and wear properties, and with low friction performance, over a wide range of loads, speeds and temperatures, in dry or wet (sweet and salty water) operation conditions. Such material may be polytetrafluorethylene (PTFE), or any other composite material with similar self-lubricating and antifriction properties. The roller assembly 12 according to an embodiment of the present invention can therefore easily be attached and detached to the roller bitt assembly, which facilitates the mounting, demounting and repairing tasks From FIG. 4 it can also be seen that according to an embodiment of the invention, the arched structure 11 comprises at least one guide 23 to which the coupling means 13 is coupled for guiding the roller assembly 12 along the centre line 15 of the arched structure. The guide 23 may be in the form of a track to which the coupling means is coupled through a protruding part complementary to the track, in the form of a hook-like track for which the coupling means has a complementary part, or any other suitable guiding means.

The roller assembly 12 according to an embodiment of the invention is configured to rotate when the external pulling force coming from the assisted ship exerted on the rope 17 has a direction defining an angle between 0 degrees and +90 degrees, considered with respect to a plane parallel to the plane of the deck housing 24.

The roller assembly 12 according to an embodiment of the invention may be detachable from the arched structure 11 so that it can be easily mounted/demounted and repaired.

Figure 5:
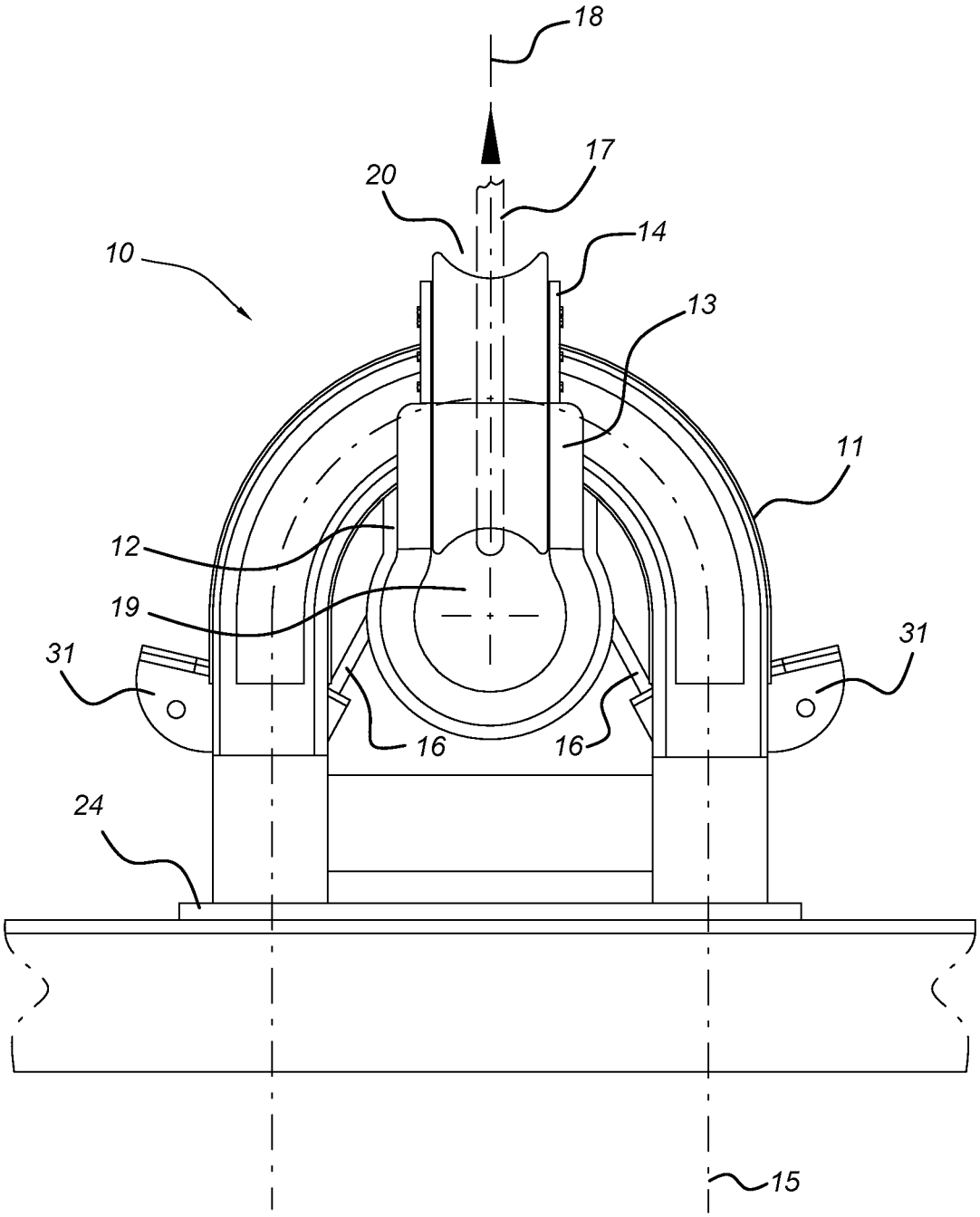
FIG. 5 shows a front view of a towing bitt assembly in a neutral position according to an embodiment of the invention

FIG. 5 shows a front view of a towing bitt assembly in a neutral position according to an embodiment of the invention.

The roller assembly 12 of the towing bitt assembly 10 according to an embodiment of the invention can move along a centre line 15 of the arched structure 11 within a predetermined angular range. The roller assembly 12 may be moved from an angular position of −90 degrees to +90 degrees with respect to the central position 18 of the arched structure. The damper elements 16 may control the roller assembly 12 not to move outside the range of −90 degrees to +90 degrees. According to an embodiment of the invention, at least one stopper 31 may be placed on each side of the arched structure 11. The stoppers may add extra security as they may stop the roller assembly 12 from moving along the arched structure 11 further than a specific position, so that the roller assembly will not move outside the desired angular ranges. Even if the damper means 16 are damaged or do not function properly, the stoppers 31 will still keep the roller assembly 12 within the desired moving range.

Figure 6:
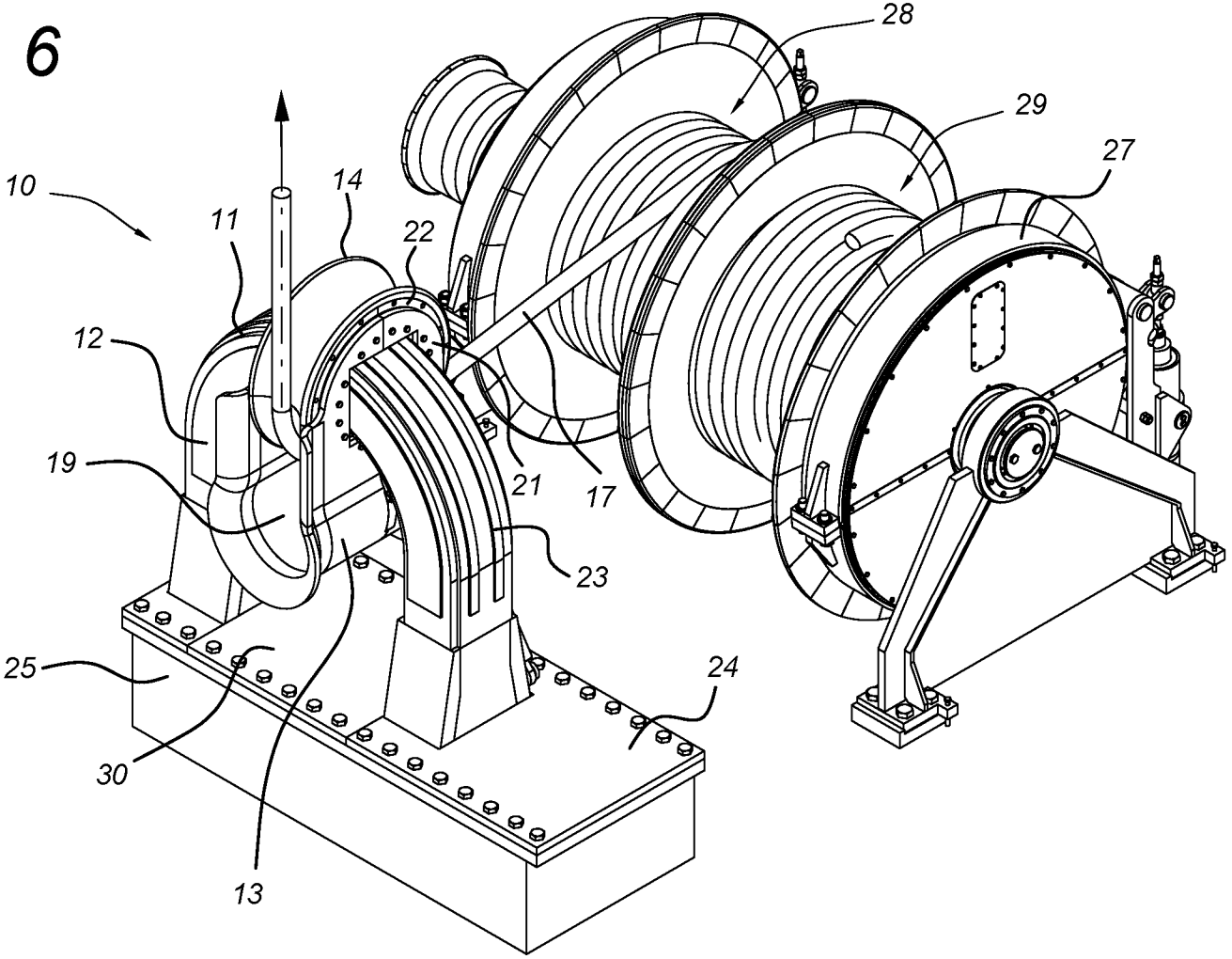
FIG. 6 shows an isometric view of a towing bitt assembly configured to be used with a double drum towing winch according to an embodiment of the present invention

FIG. 6 shows an isometric view of a towing bitt assembly configured to be used with a double drum towing winch according to an embodiment of the present invention.

According to one embodiment of the present invention, if the roller bit assembly 10 is to be used with a single-drum towing winch 17, the arched structure 11 may be fixed to the deck of a towing ship by welding or other suitable technique, or the roller bitt assembly may comprise a deck housing so that the arched structure 11 may fixed in a specific position of the deck housing 24. According to another embodiment of the invention, the arched structure 11 may be located in one of at least a first position 25 and a second position 26 on the deck housing 24. The deck housing 24 may have guiding means 30 to allow the arched structure 11 to move from one position to another. This may be done when the towing bitt assembly 10 is configured to operate with a towing winch 27 having multiple towing drums, such as, but not limited to, a first 28 and second 29 drum. In this scenario, the first position 25 may be aligned for guiding a rope 17 from the first drum 28 of the towing winch 27 and the second position 26 may be aligned for guiding the rope 17 from the second drum 29.

According to an embodiment of the invention, the towing winch 27 may be configured to roll the towing rope 17 and release it from an upper part of the towing winch. According to another embodiment, the towing winch 27 may be configured to roll the rope and release it from underneath the towing winch.

Figure 7:
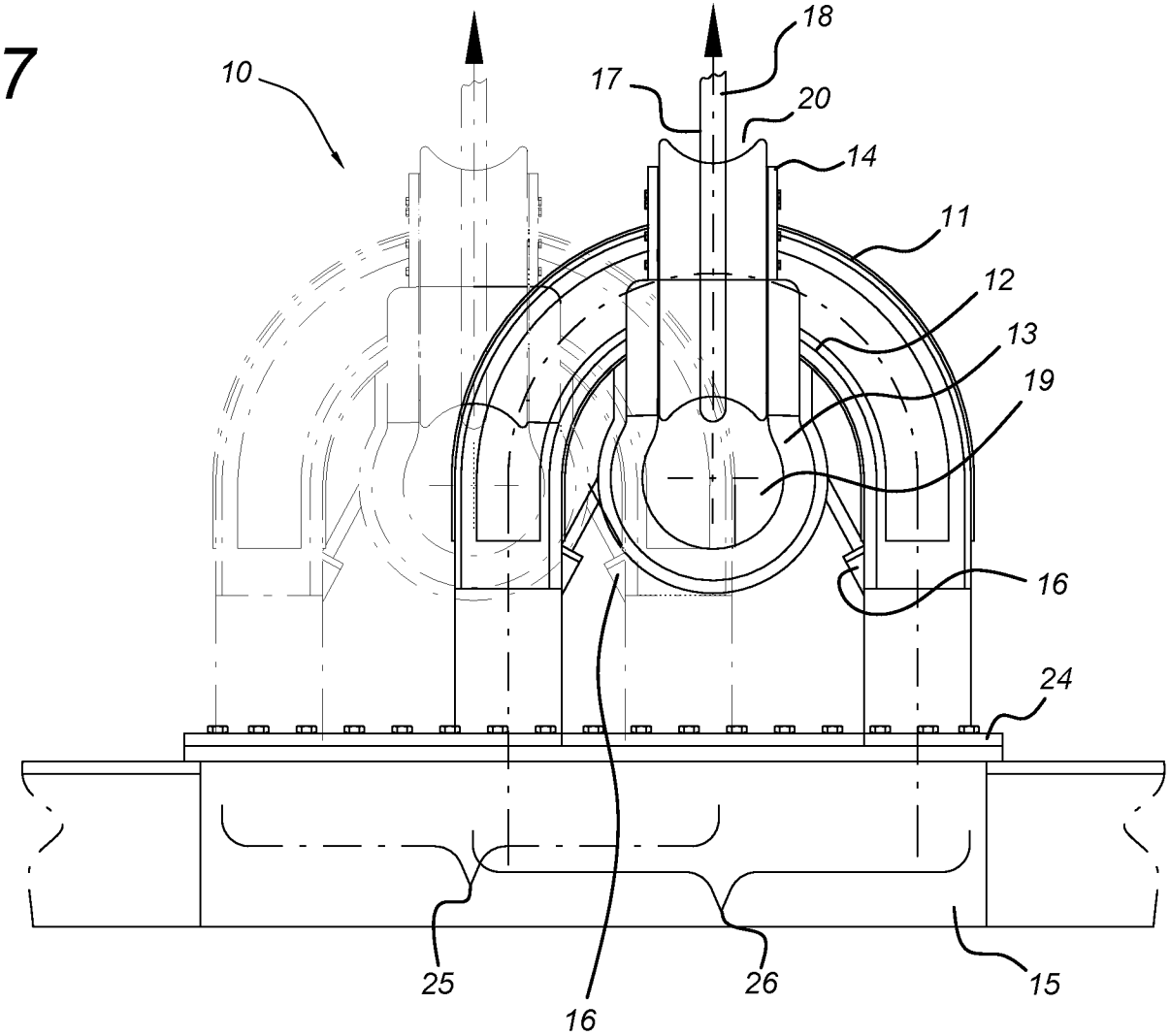
FIG. 7 illustrates a front view of a towing bitt assembly configured to be used with a double drum towing winch according to an embodiment of the present invention

FIG. 7 illustrates a front view of a towing bitt assembly configured to be used with a double drum towing winch according to an embodiment of the present invention.

The arched structure 11 of the towing bitt assembly 10 according to an embodiment of the present invention may be moved through the guide means 30 of the deck housing 24 in order to be placed in one of at least two positions so that the towing bitt assembly 10 can more efficiently operate with any one of at least two drums in a multiple-drum towing winch.

In the foregoing description of the figures, the invention has been described with reference to specific embodiments thereof. It will, however, be evident that various modifications and changes may be made thereto without departing from the scope of the invention as summarized in the attached claims.

In particular, combinations of specific features of various aspects of the invention may be made. An aspect of the invention may be further advantageously enhanced by adding a feature that was described in relation to another aspect of the invention.

It is to be understood that the invention is limited by the annexed claims and its technical equivalents only. In this document and in its claims, the verb "to comprise" and its conjugations are used in their non-limiting sense to mean that items following the word are included, without excluding items not specifically mentioned. In addition, reference to an element by the indefinite article "a" or "an" does not exclude the possibility that more than one of the element is present, unless the context clearly requires that there be one and only one of the elements. The indefinite article "a" or "an" thus usually means "at least one".

LIST OF REFERENCE SYMBOLS

Similar reference numbers that have been used in the description to indicate similar elements (but differing only in the hundreds) have been omitted from the list below, but should be considered implicitly included.

10 Towing bitt assembly
11 Arched structure
12 Roller assembly
13 Coupling means
14 Roller means
15 Centre line
16 Damper means
17 Towing rope
18 Central position
19 Nozzle
20 Concave outer surface
21 First set of screws
22 Second set of screws
23 Guide
24 Deck housing
25 First position
26 Second position
27 Towing winch
28 First drum
29 Second drum
30 Guiding system
31 Stoppers

The invention claimed is:

1. A towing bitt assembly comprising:
an arched structure defining an opening for a towing rope to run there through;
a roller assembly comprising
a coupling means fastened around the arched structure for coupling the roller assembly to the arched structure so that the roller assembly is movable along a centre line of the arched structure; and
a roller means for guiding the towing rope, the roller means surrounding a section of the coupling means fastened to the arched structure, and being rotatable around the centre line of the arched structure; and
at least one damper means connected to the arched structure and to the roller assembly, wherein the at least one damper means is configured to exert a force causing the roller assembly to move to a central position along the arched structure.

2. The towing bitt assembly according to claim 1, wherein an even number of damper means are provided, positioned symmetrically with respect to a plane through the central position along the arched structure.

3. The towing bitt assembly according to claim 1, wherein the damping means are hydraulic damping means.

4. The towing bitt assembly according to claim 1, wherein the roller assembly comprises a nozzle for the towing rope to run there through.

5. The towing bitt assembly according to claim 1, wherein the roller means is formed as a wheel having a concave outer surface for guiding the towing rope.

6. The towing bitt assembly according to claim 1, wherein at least one slide bearing is provided between the roller means and the coupling means.

7. The towing bitt assembly according to claim 1, wherein the arched structure comprises at least one guide to which the coupling means is coupled for guiding movement along the centre line of the arched structure.

8. The towing bitt assembly according to claim 1, wherein the roller assembly can be moved along the arched structure within an angular range between −90 degrees and +90 degrees, wherein an angular position within the angular range is defined with respect to a central position along the arched structure.

9. The towing bitt assembly according to claim 8, wherein the angular range is between −90 degrees and +90 degrees with respect to the central position along the arched structure.

10. The towing bitt assembly according to claim 9, wherein the angular range is between −80 degrees and +80 degrees with respect to the central position along the arched structure.

11. The towing bitt assembly according to claim 1, wherein at least one stopper is located on each side of the arched structure to keep the roller assembly within a predefined angular range with respect to a central position along the arched structure.

12. The towing bitt assembly according to claim 1, wherein the arched structure has a U-shape.

13. The towing bitt assembly according to claim 1, further comprising a deck housing for fixing the arched structure to a deck of a boat.

14. The towing bitt assembly according to claim 13, wherein the deck housing allows the arched structure to have one of at least a first and a second position, the first and the second position being spaced apart by a distance.

15. The towing bitt assembly according to claim 14, further comprising a towing winch with a first and a second drum, wherein the first position is aligned for guiding a rope from the first drum and the second position is aligned for guiding a rope from the second drum.

16. The towing bitt assembly according to claim 14, wherein the deck housing comprises a guiding system, and wherein the arched structure is configured to slide along the guiding system of the base in order to move between the first and the second position.

* * * * *